US009841144B2

(12) United States Patent
Gan

(10) Patent No.: US 9,841,144 B2
(45) Date of Patent: Dec. 12, 2017

(54) BALLOON PUMPER HAVING RELIEF VALVE

(71) Applicant: MerchSource, ILC, Irvine, CA (US)

(72) Inventor: Chon Seong Gan, Irvine, CA (US)

(73) Assignee: MerchSource, LLC, Irvine, CA (US)

( * ) Notice: Subject to any disclaimer, the term of this patent is extended or adjusted under 35 U.S.C. 154(b) by 119 days.

(21) Appl. No.: 14/279,194

(22) Filed: May 15, 2014

(65) Prior Publication Data

US 2014/0290794 A1 Oct. 2, 2014

Related U.S. Application Data

(60) Provisional application No. 61/956,015, filed on Mar. 15, 2013.

(51) Int. Cl.

| | |
|---|---|
| ***F17C 7/00*** | (2006.01) |
| ***A63H 27/10*** | (2006.01) |
| ***B05B 9/08*** | (2006.01) |
| ***F04B 9/14*** | (2006.01) |

(52) U.S. Cl.

CPC ..... *F17C 7/00* (2013.01); *A63H 27/10* (2013.01); *B05B 9/0827* (2013.01); *F04B 9/14* (2013.01); *A63H 2027/1033* (2013.01)

(58) Field of Classification Search

CPC ... B05B 9/0816; B05B 9/0822; B05B 9/0827; F04B 9/14; A63H 2027/1033

USPC ..... 141/10, 114, 313–317

See application file for complete search history.

(56) References Cited

U.S. PATENT DOCUMENTS

| | | | | |
|---|---|---|---|---|
| 4,537,334 | A * | 8/1985 | Spengler | A47L 11/1625 222/401 |
| 4,955,412 | A * | 9/1990 | Younts | A63H 27/10 141/10 |
| 5,558,139 | A * | 9/1996 | Snyder | A62B 7/02 128/201.21 |
| 5,603,361 | A | 2/1997 | Cuisinier | |
| 6,916,262 | B2 * | 7/2005 | Lacroix | A63B 41/00 473/593 |
| 8,074,838 | B1 * | 12/2011 | Tate | F41B 9/00 222/429 |
| 2003/0130076 | A1 * | 7/2003 | Lacroix | A63B 41/00 473/593 |
| 2011/0079316 | A1 | 4/2011 | Ramere | |
| 2012/0067453 | A1 | 3/2012 | Ramere et al. | |

* cited by examiner

*Primary Examiner* — Nicolas A Arnett

(74) *Attorney, Agent, or Firm* — Avyno Law P.C.

(57) ABSTRACT

A balloon filling device is provided for filling balloons with air or water. The balloon filling device includes a container for holding fluid, a pump mechanism for pressurizing the container and a trigger mechanism for releasing fluid in the container. The trigger mechanism includes a nozzle for attaching and holding a balloon while releasing pressurized air or liquid within the container into the balloon. The pump mechanism includes a pressure relief valve for releasing air back through the pump mechanism to the outside of the container when the container is over-pressurized.

4 Claims, 10 Drawing Sheets

BALLOON PUMPER HAVING RELIEF VALVE

RELATED APPLICATIONS

This application claims priority of U.S. Provisional Patent Application Ser. No. 61/956,015, filed on Mar. 15, 2013, titled BALLOON PUMPER HAVING RELIEF VALVE, which application is incorporated in its entirety by reference in this application.

FIELD OF THE INVENTION

This invention relates to a device capable of filling balloons with water, air or a mixture of air and water. In particular, the device includes a container capable of holding water that can be pressurized by an integrated pump, where the integrated pump includes a release valve to prevent over-pressurizing the container.

BACKGROUND OF THE INVENTION

It is known that balloons may be inflated by pressurizing containers with air utilizing a pump and then releasing the pressurized air through a nozzle on the pump. To inflate the balloon, the balloon is placed on the nozzle of pump. The pressurized air in the container is then released through the nozzle on the pump to inflate the balloon. This basic operation of inflating balloons utilizing pumps connected to containers is taught in U.S. Pat. No. 4,634,395.

A problem, however, exists in that it is possible for a user to over-pressurize a container utilizing a pump. If over-pressurized, the pump may become damaged or the container itself may rupture or explode. As the balloon pumps are currently marketed and sold primarily to children, the explosion of the container raises safety consideration.

A need therefore exists for a balloon pump that includes a mechanism for releasing air when the container is over-pressurized to avoid damage to the pump.

SUMMARY

A balloon filling device is provided for filling balloons with air or water. The balloon filling device includes a container for holding fluid, a pump mechanism for pressurizing the container and a trigger mechanism for releasing fluid in the container. The pump mechanism is secured to the top of the container via a lid attachment. The trigger mechanism is attached to the lid attachment and includes a nozzle for attaching and holding a balloon and releasing pressurized air or liquid within the container into the balloon. The pump mechanism includes a pressure relief valve for releasing air back through the pump mechanism to the outside of the container when the container is over-pressurized.

In operation, the container is pressurized by the repeated upward and downward motion of the pump handle. The pump mechanism includes a one-way valve, such that pressure applied to the container does not flow back into the pump mechanism. Once the container is pressurized, the air or water in the container may then be released by depressing the trigger release. Upon depressing the trigger release, liquid or air is allowed to flow from the container through the nozzle and into an attached balloon. The fluid and/or air is released through a tube positioned within the container that communicates with the trigger release and nozzle.

As noted above, over-pressurization of the container can cause the container to rupture or cause damage to the pump assembly. The balloon pump of the present invention includes a pressure relief valve designed to release air from the container if the pressure in the container gets too great such that it might potentially damage or rupture the pump or the container. The relief valve can be designed to release air anywhere between 27-32 PSI.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
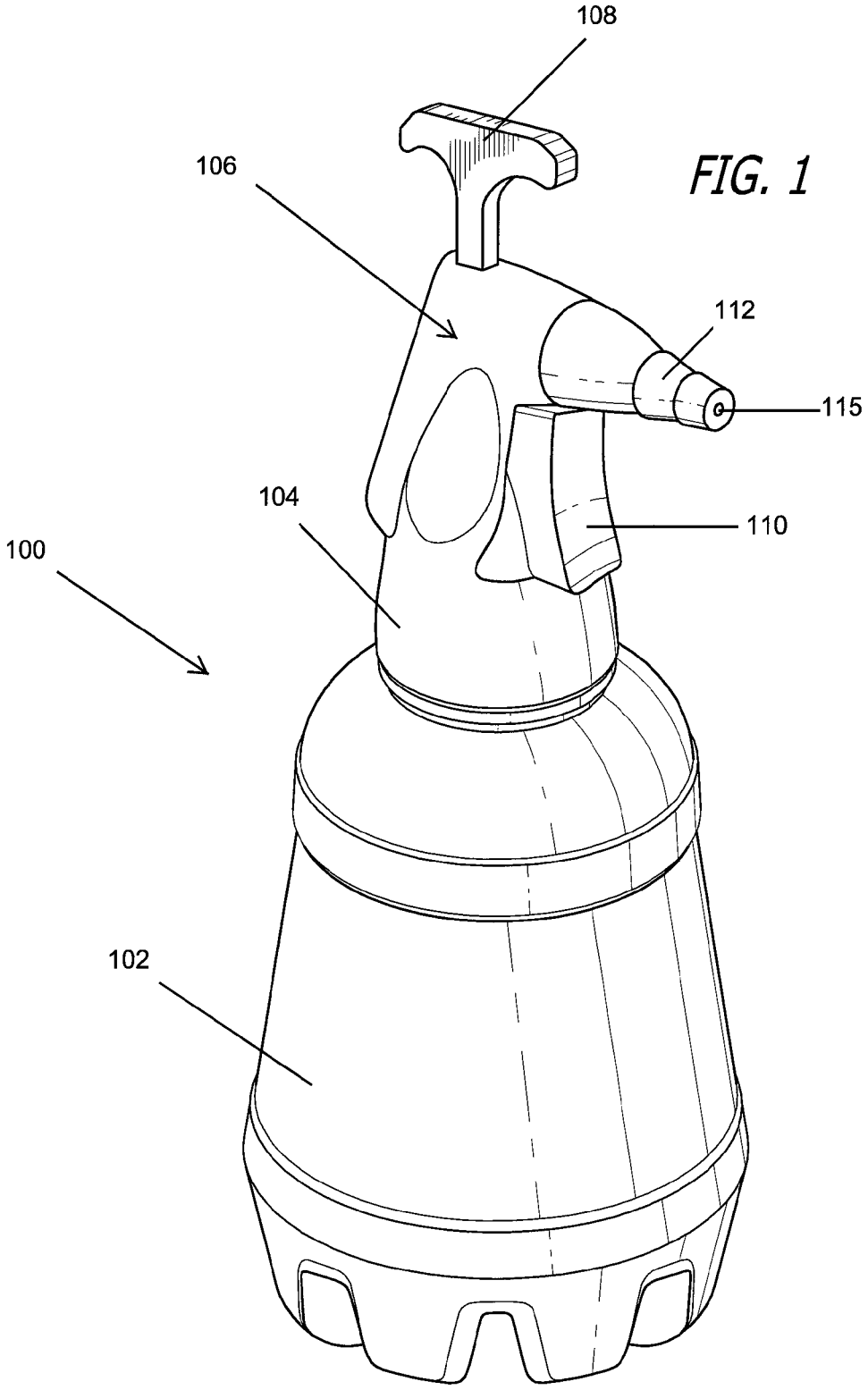
FIG. 1 is a front perspective view of one example of a balloon pump (or balloon pumper) of the present invention.
Figure 2:
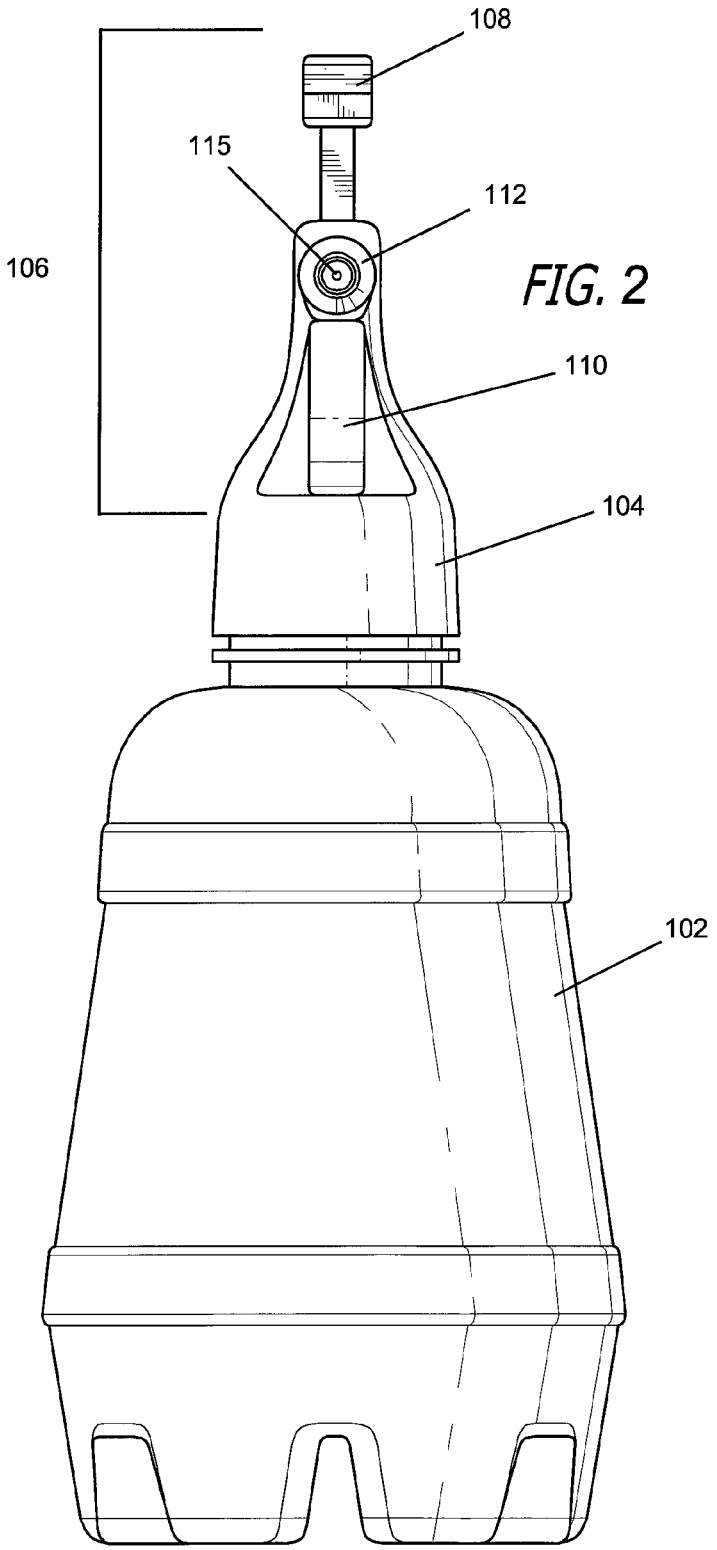
FIG. 2 is a side elevation view of the right side of the pump.

FIG. 1 is a front perspective view of one example of a balloon pump 100 (or balloon pumper) of the present invention. FIG. 2 is a side elevation view of the right side of the balloon pump 100. As illustrated in FIGS. 1 & 2, the balloon pump 100 includes a container 102 having a lid attachment 104 that includes a pumping mechanism 106. The pump mechanism 106 includes a pump handle 108, a trigger release 110 and a nozzle 112 to release fluid from the container 102 through the nozzle 112 to inflate a balloon (not shown) upon the engagement of the trigger release 110.

The container 102 may be made of a plastic and capable of holding water and pressure up to about 30 PSI. For purposes of this invention the plastics can be polyethylene, polypropylene, polyethylene terthalate (PET), polycarbonate, or any similar material. "Fluid" shall mean any liquid or gas, including, but not limited to, water or air.

Figure 3:
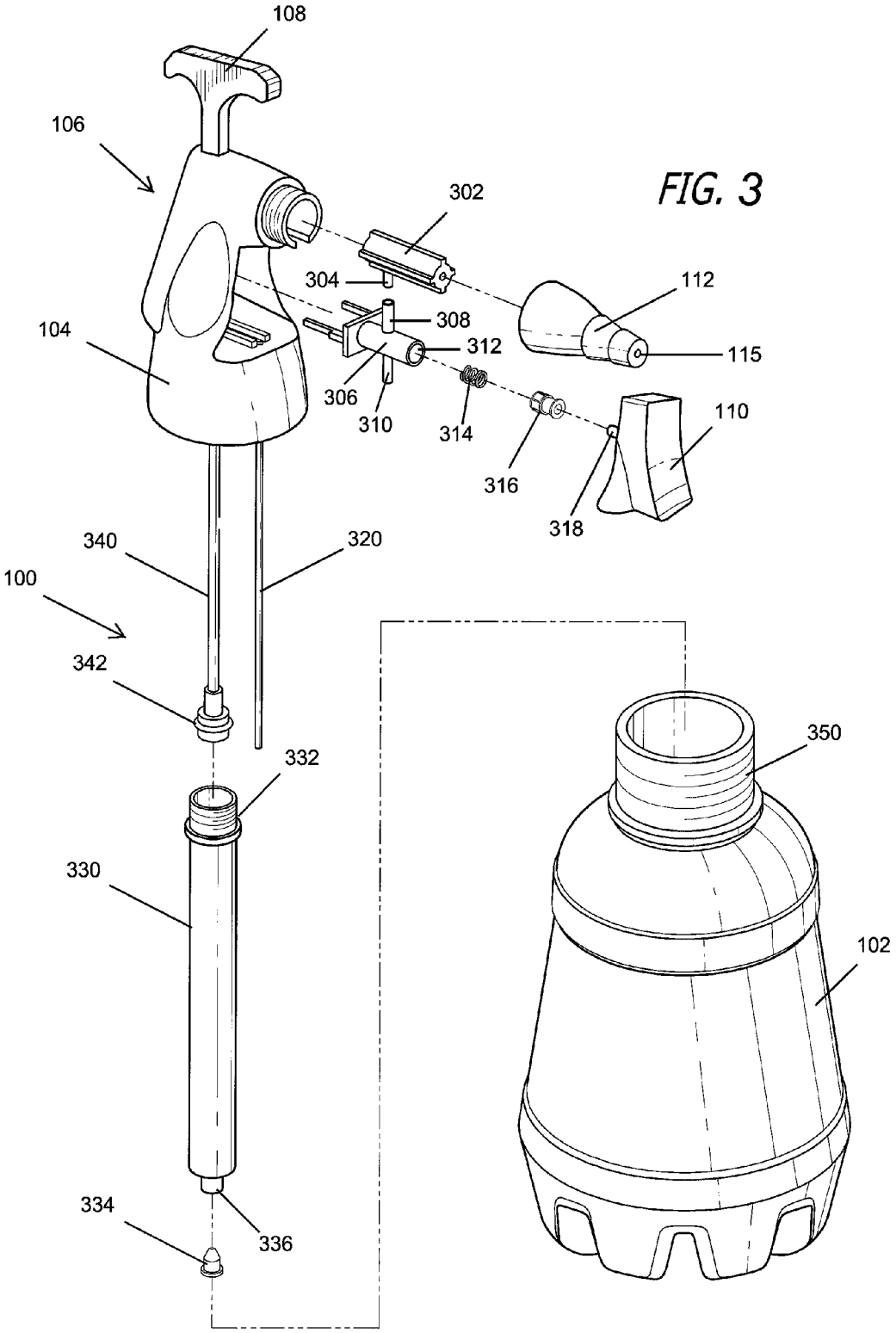
FIG. 3 is an exploded perspective view of the balloon pump of the present invention.

FIG. 3 is an exploded perspective view of the balloon pump 100 of the present invention. As illustrated in FIG. 3, the container 102 has a threaded top 350 for engaging the lid attachment 104. The lid attachment 104 includes a pump mechanism 106 that includes a pump handle 108, a nozzle 112 and a trigger 110.

A fluid passageway is defined from the container 102 to the opening 115 on the nozzle 112 through the tube 320, trigger 110 and the nozzle 112 to facilitate the release of fluid from the nozzle 112 once the container 102 is pressurized. The trigger 110 includes at its rear side a peg 318 which interfaces with a plug 316. The plug 316 rests upon a trigger spring 314 in a central housing 312 located within a trigger insert 306. The trigger insert 306 includes an airflow passageway defined by an upper pipe 308 and a lower airway pipe 310 and the central housing 312. The plug 316 is able to slide within the central housing 312 of the trigger insert 306 upon the compression of the trigger 110, which compresses spring 314. The sliding movement of the plug 316 opens and closes the airflow between the upper pipe 308 and the lower pipe 310 to facilitate fluid communication through the trigger insert 306 when the trigger 110 is depressed.

The nozzle 112 includes a nozzle insert 302 that includes an airflow passageway directing fluid communication from the trigger through the nozzle insert 302 and out of the nozzle opening 115. The nozzle insert 302 includes a downward spout 304 for interfacing and communicating with the upper airway pipe 308 of the trigger insert 306 to create an airflow passageway from the container tube 320 through the lower airway pipe 310 to the upper airway pipe 308 through the downward spout 304, through the nozzle insert 302 and out the opening of the nozzle 112.

To create pressure in the container 102, the pump handle 108 is connected to a rod 340 that extends downward through the pump mechanism 106 into the container 102. The pump mechanism 106 further includes a plunger 342 located at the bottom of the rod 340. Plunger 342 and rod 340 are housed inside a sleeve 330 having a threaded top 332 for threadably engaging to the underside of the lid attachment 104 (see FIG. 4). The sleeve 330 at its bottom includes an open end 336 for housing a one-way valve 334, such that the pressure applied to the container 102 does not back flow into the pump mechanism 106. Such one-way valves 334 are well known in the art and are typically made of a flap of rubber or movable ball that will allow the pumped fluid to flow out through the sleeve 330 but not in reverse.

Figure 4:
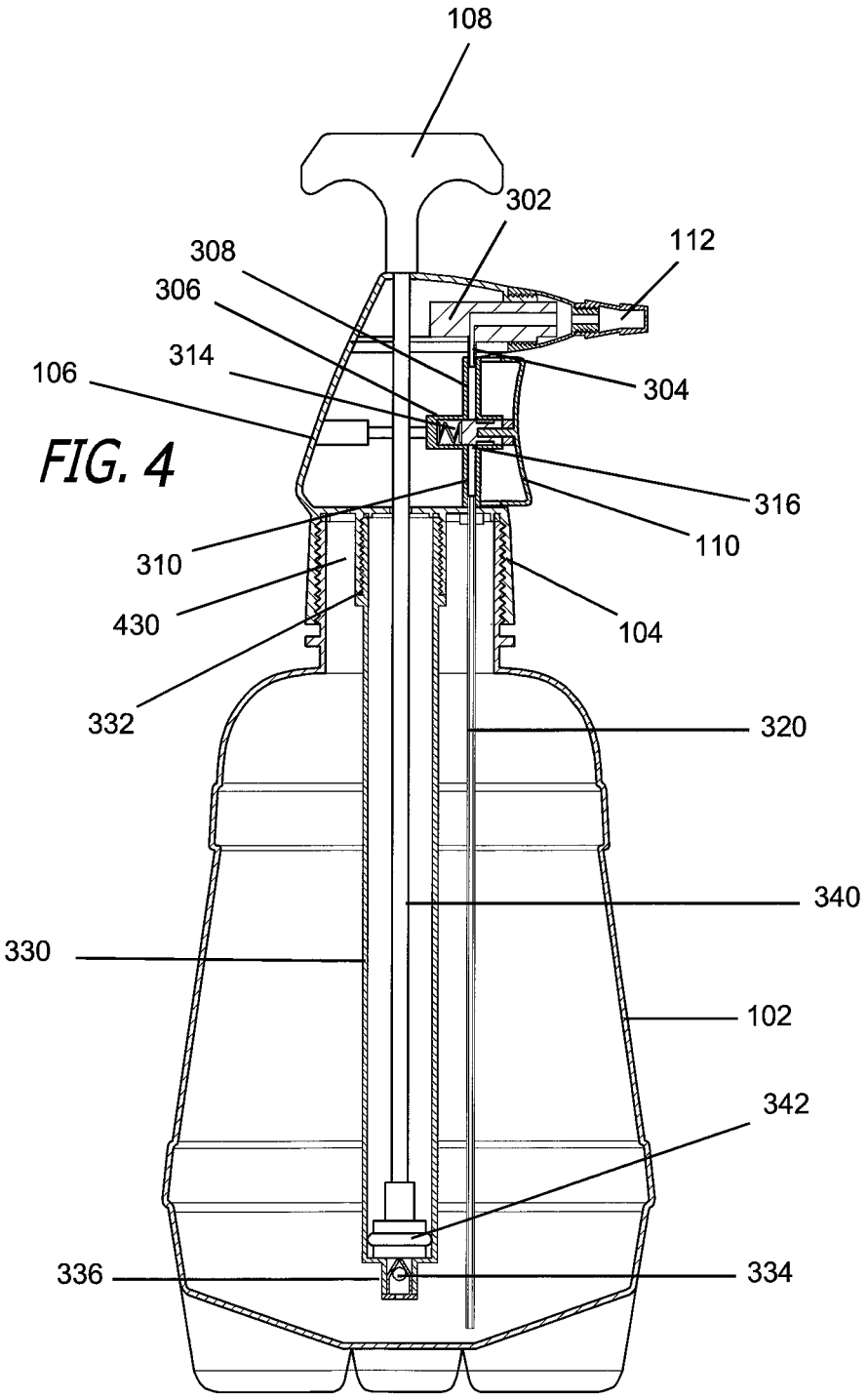
FIG. 4 is a cross-section of the pump of FIG. 1 taken along the vertical center illustrating the pump handle in a retracted position.

FIG. 4 is a cross-section of the pump 100 of FIG. 1 taken along the vertical center illustrating the pump handle 108 in a retracted or closed position. As illustrated in FIG. 4, the lid attachment 104 threadably mounts the top of the container 102. The pump mechanism 106 is then utilized to pressurize the container 102. The pump handle 108 has a rod 340 that extends through the trigger mechanism 106 and the lid attachment 104 into the sleeve 330, which is threadably mounted to the underside of the lid attachment 104 via a threaded receptacle 430. The rod 340 at the end opposite the handle 108 includes a plunger 342 for pressurizing the container 102 through pumping action of the plunger 340 through the sleeve 330. As best illustrated in FIG. 4, the sleeve 330 at its bottom includes a one-way valve 334, which in the illustrated example, is a ball valve, located within an opening 336 of the sleeve 330.

Figure 5:
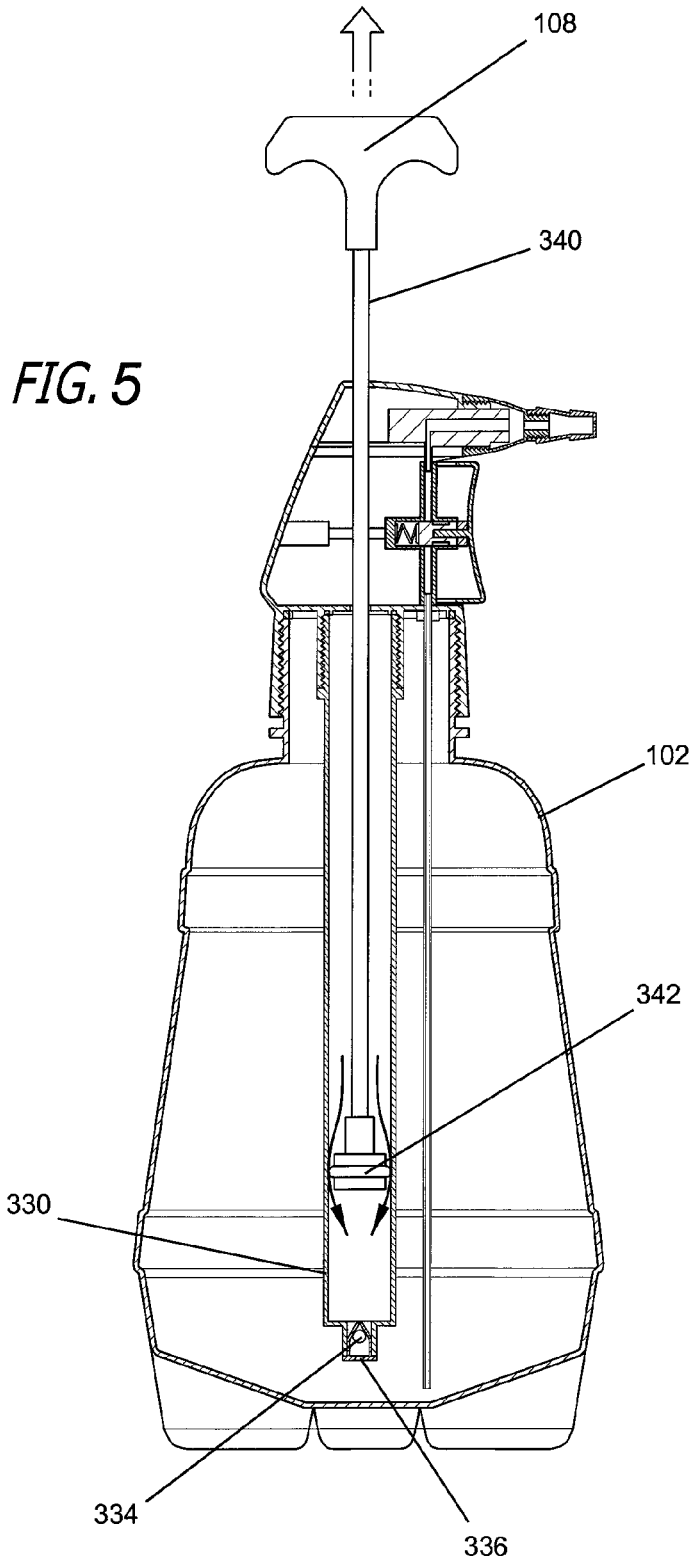
FIG. 5 is a cross-section taken along the vertical center of the pump of FIG. 1 illustrating the air flow pattern as the handle is drawn upward or is extended.
Figure 6:
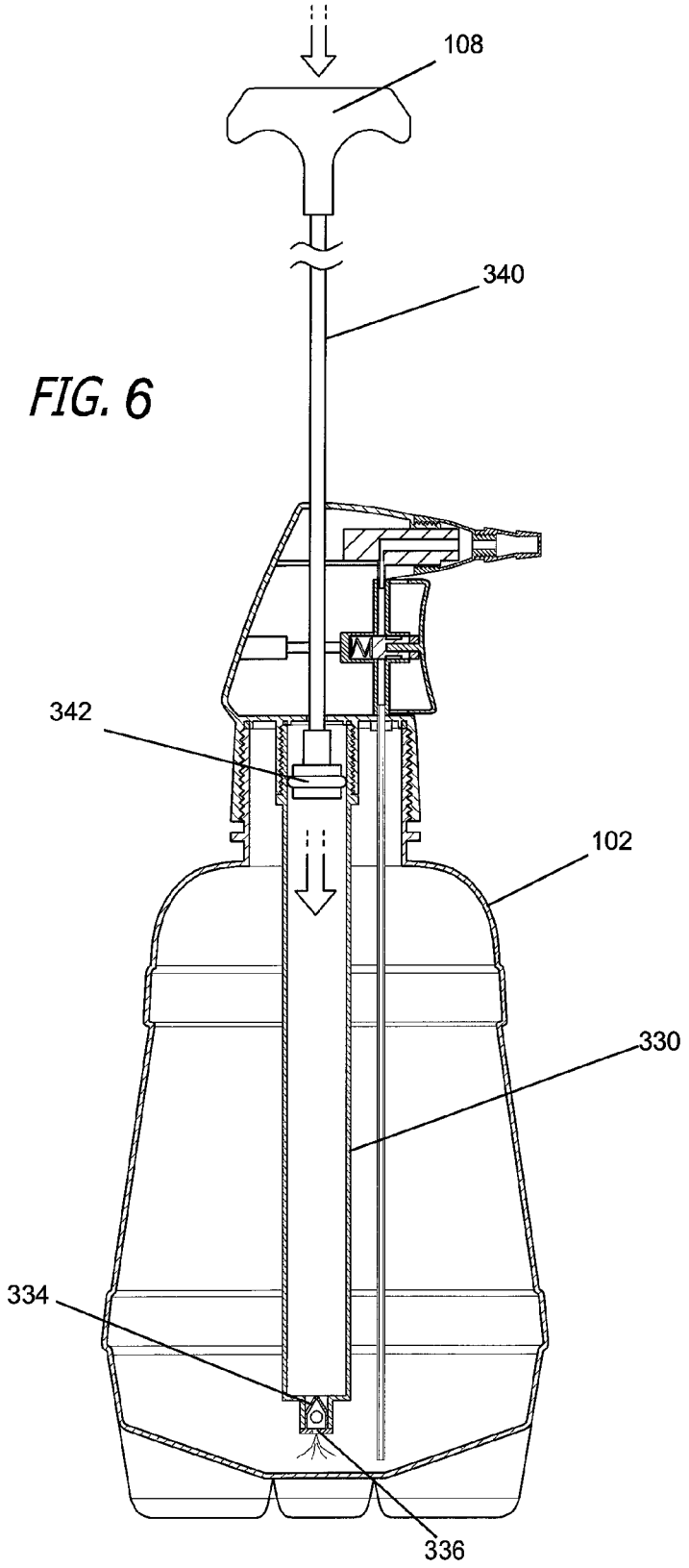
FIG. 6 is a cross-section of the pump of FIG. 1 taken along the vertical center illustrating the air flow pattern as the handle is pressed downward into the container.

As will be seen better in FIGS. 5 and 6, the one-way valve 334 is opened in response to downward air pressure from the plunger 342 moving through the sleeve order to pressurize the container 102. The valve 334 remains closed when the plunger is extended upward to draw air into the sleeve 334, thereby preventing the release of pressure from the container 102.

FIG. 5 is a cross-section taken along the vertical center of the pump of FIG. 1 illustrating the air flow pattern as the handle 108 is drawn upward or is extended. As seen in FIG. 5, when the plunger 342 and rod 340 are pulled upward by pulling the pump handle 108, air is forced downward past the sides of the plunger 304 within the sleeve 330 to create air in the portion of the sleeve 330 below the plunger 342 when retracted. When the plunger is being retracted, the one-way valve 334 closes the opening 336 preventing any air from escaping into the chamber 102.

FIG. 6 is a cross-section of the pump 100 of FIG. 1 taken along the vertical center illustrating the air flow pattern as the handle 108 is pressed downward into the container 102. As illustrated in FIG. 6, when the pump handle 108 is pressed downward from the retracted position, the plunger 342 forces all of the air in the sleeve 330 created between the plunger 342 and the sleeve 330 out the bottom of the sleeve 330 at opening 336. The air pressure being forced downward by the plunger 342 within the sleeve 330 opens the valve 334 to allow air to flow into the container 102 to pressurize the container 102.

Figure 7:
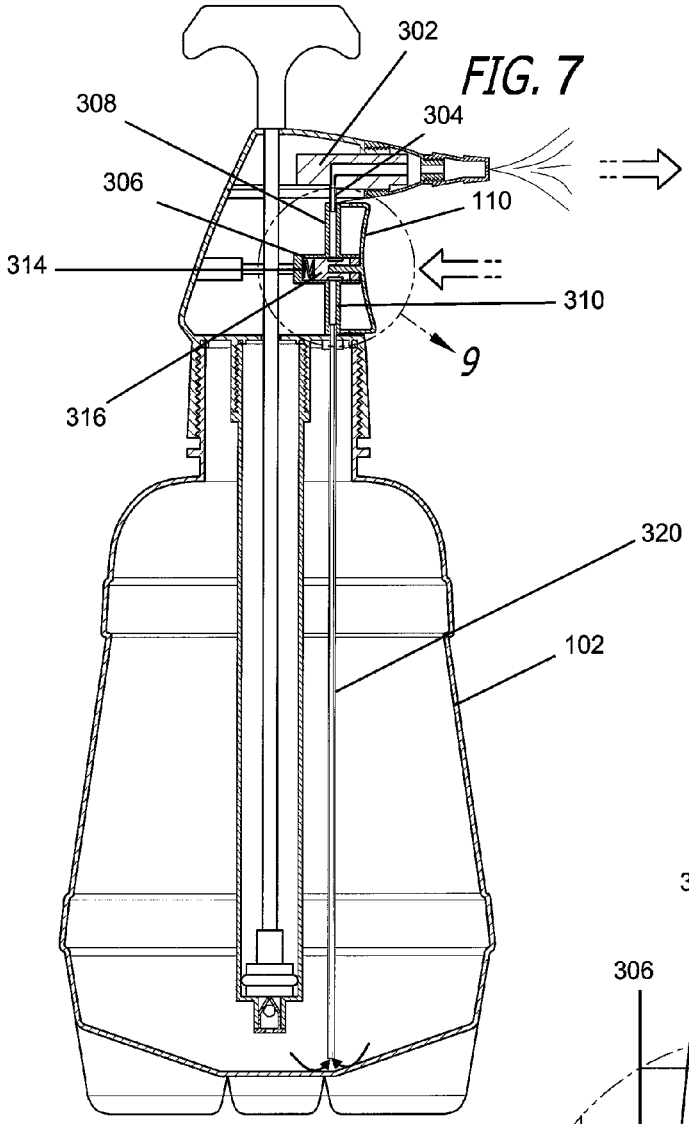
FIG. 7 is a cross-section of the pump of FIG. 1 taken along the vertical center illustrating the air flow pattern as the trigger is pressed to release the air in the container.

FIG. 7 is a cross-section of the pump 100 of FIG. 1 taken along the vertical center illustrating the air flow pattern as the trigger 110 is pressed to release the air in the container 102. Once the container 102 is pressurized, the fluid in the container 102 may be released through the tube 320 which interfaces, and is in communication with, the trigger mechanism.

Figure 8:
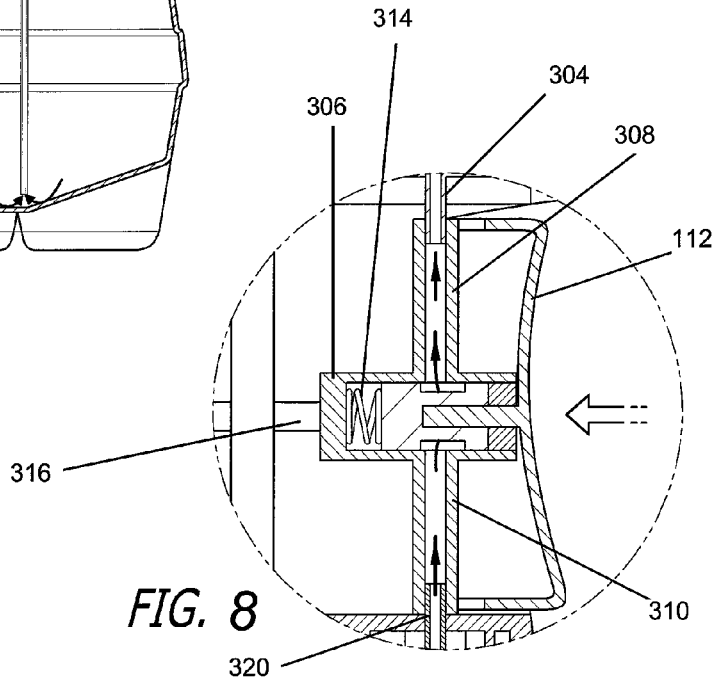
FIG. 8 is an enlarged view of the trigger release of the pump.

FIG. 8 is an enlarged view of the trigger mechanism of the pump 100. As best illustrated in FIG. 8, the tube 320 is in fluid communication with lower airway pipe 310 of the trigger insert 306. When the plug 316 is forced inward by depressing the trigger 110, the airflow passages in the upper and lower airway pipes 308, 301 are opened. Because the upper airway pipe 308 interfaces, and is in communication with, the downward spout 304 and the nozzle insert 302, which have airflow passages to the opening 115 of the nozzle 112, fluid is able to exit through the opening 115 of the nozzle 112 when the trigger 110 is depressed after the container 102 is pressurized.

Figure 9:
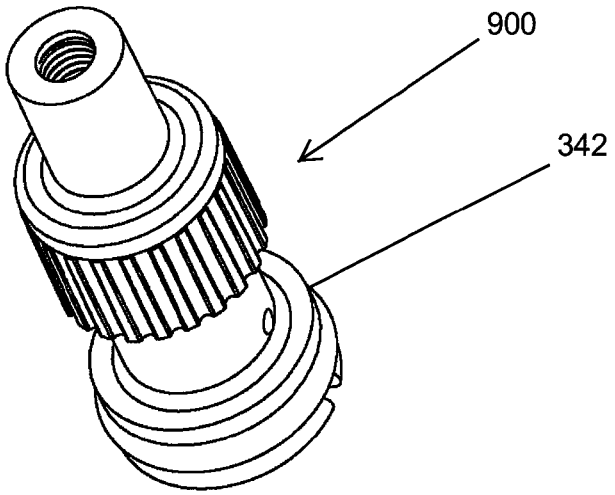
FIG. 9 is a top perspective view of one example of a relief valve that may be utilized in connection with the pump of the present invention to release air from the container should the container's pressure reach a threshold amount.

FIG. 9 is a top perspective view of one example of a relief valve 900 that may be utilized in connection with the pump 100 of the present invention to release air from the container 102 should the container's pressure reach a threshold amount. FIG. 9 shows a top perspective view of one example of a relief valve 900 embedded within the plunger 342. The relief valve 900 allows the release of air pressure 102 to backflow through the sleeve 330 when the pressure inside the container 102 is too great.

Figure 10:
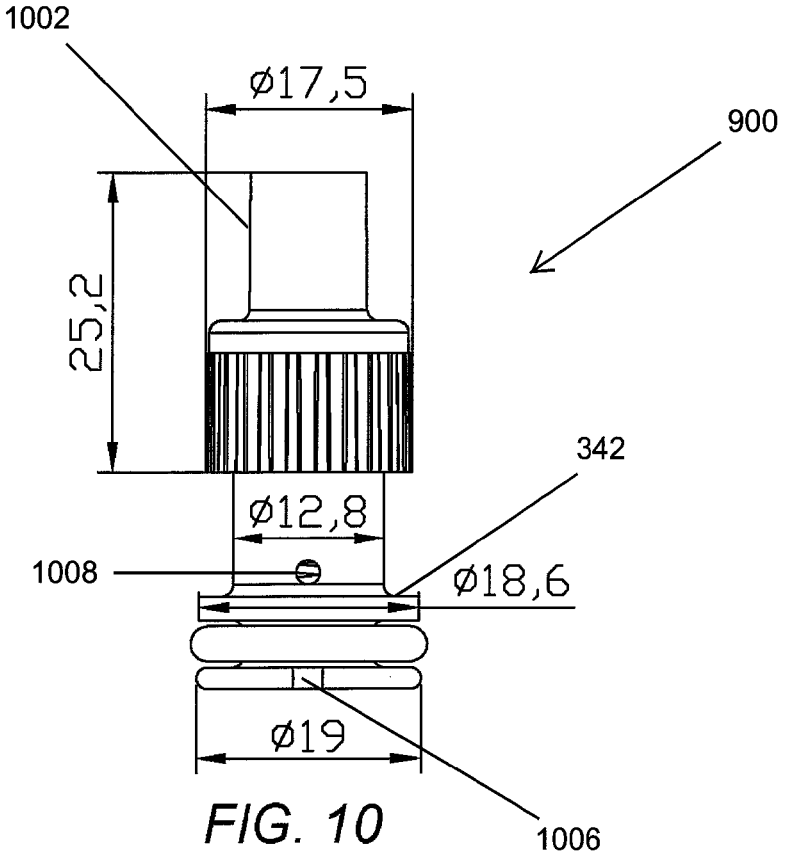
FIG. 10 is a side view of the pressure relief valve of FIG. 9.

FIG. 10 is a side view of the pressure relief valve 900 of FIG. 9. FIG. 10 illustrates the plunger 342 having a rod attachment 1002 threadably engaged to the top of the plunger 1004 for attaching the plunger 1004 to the rod 340. The plunger 1004 includes at its bottom, an opening 1006 and openings 1008 along the sides.

Figure 11:
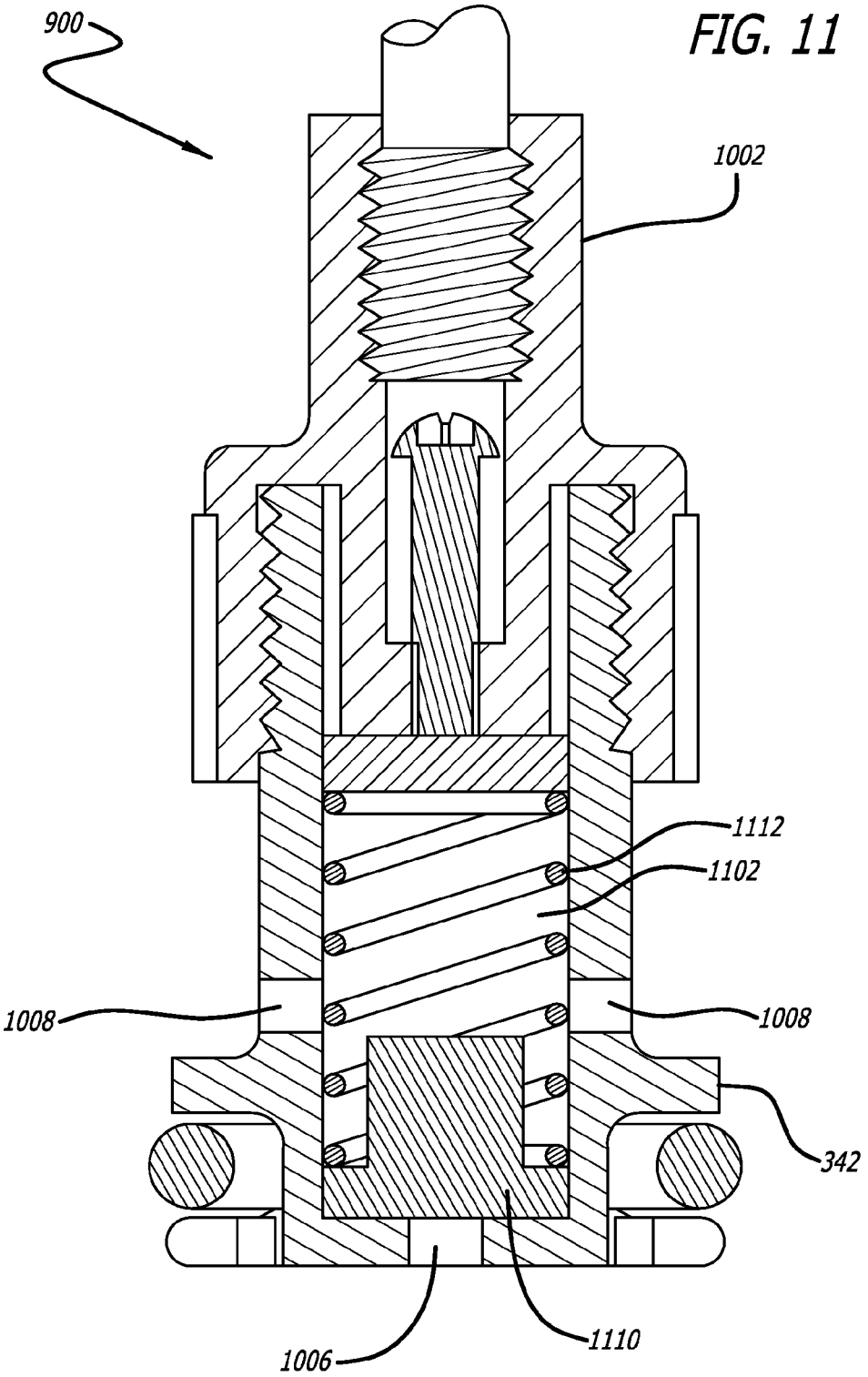
FIG. 11 is a cross-section of the relief valve of FIG. 9 with the relief valve.

FIG. 11 is a cross-section of the plunger 324 showing the relief valve 334 of FIG. 9 positioned therein. As illustrated in FIG. 11, the plunger 342 is hollowed in the center to allow communication between the openings 1006 inside openings 1008. Within the hollowed chamber 1102 of the plunger 342 rests a plug 1110 held in compression by spring 1112 against the opening 1006. When held against the opening 1106, the plug 1110 prevents the flow of air back into the sleeve 330.

Figure 12:
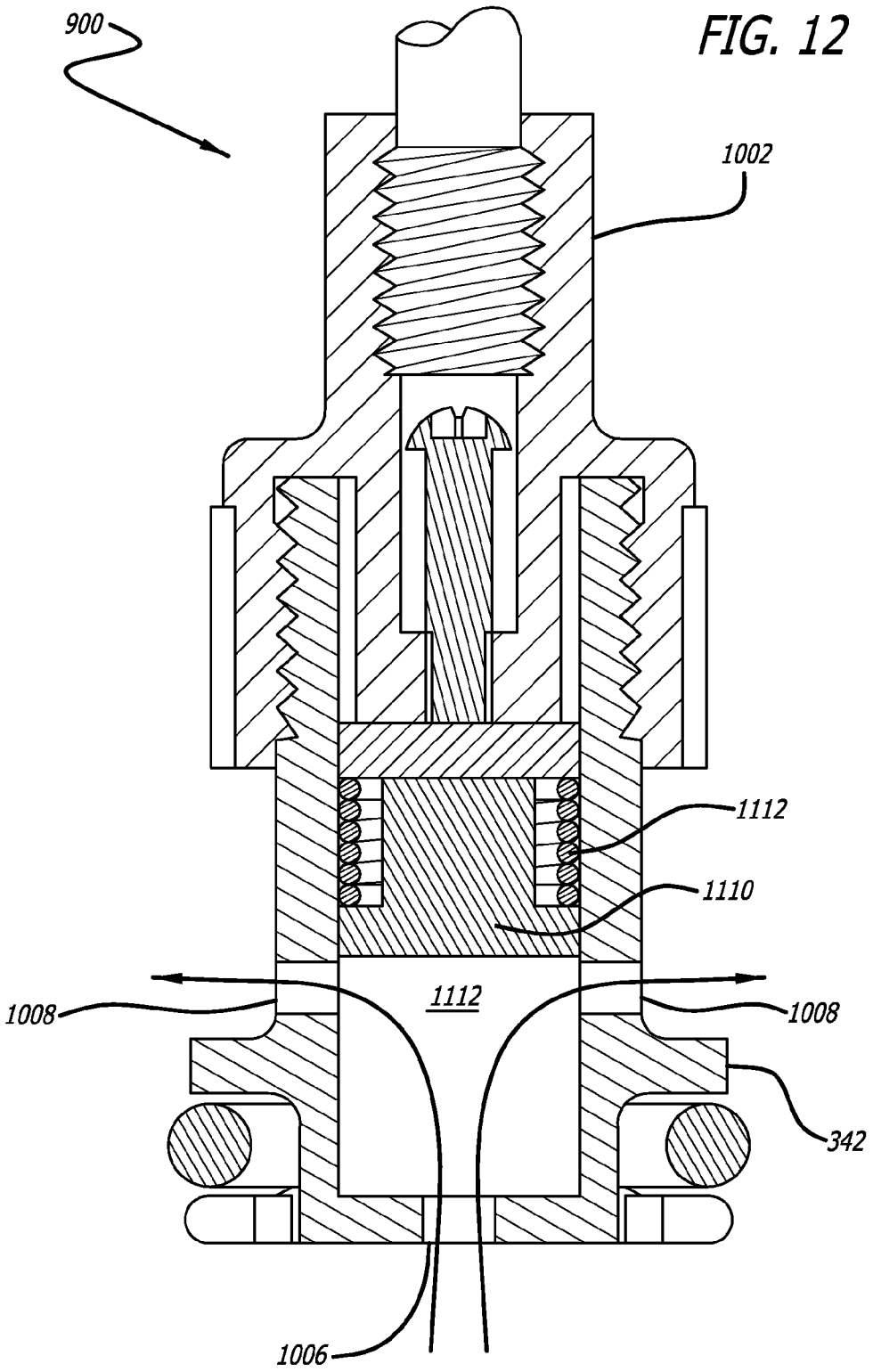
FIG. 12 is a cross-section of the relief valve of FIG. 9 showing the air flow pattern when the relief valve is triggered.

FIG. 12 is a cross-section of the plunger 324 having the relief valve 334 positioned therein, showing the air flow pattern when the relief valve 334 is triggered. As illustrated in FIG. 12, when the pressure within the container reaches approximately 27-32 PSI, the spring is then compressed by the force of the pressure against the plug 1010 to retract the plug 1010 within the chamber 1102. Once retracted, airflow is permitted to flow from opening 1006 upwards and out the side openings 1008 to release the pressure within the chamber 102 through the sleeve 330. One example of a type of spring that will compress in response to pressure of approximately 27-32 is a 5 mm×20 mm 304 gauge stainless steel spring. Those skilled in the art will recognize that other springs of varying sizes, material and gauge may be utilized given the size of the relief valve 334 and that spring selection should be based upon a response that will allow the relief valve 334 to trigger at a point when the container is pressured such that damage may occur but not before allowing the container to generate enough pressure to release fluid through the opening 115 of the nozzle 112 to fill the balloon in response to depressing trigger 110.

In operation, the container 102 is pressurized by the repeated up and down motion of the pump handle 108. The pump handle 108 is engaged with a valve 334, which is generally a one-way valve, such that pressure applied to the container 102 does not flow back into the pump mechanism 106. Once the container 102 is pressurized, the air or water in the container may be released by depressing the trigger release 110. Upon depressing the trigger release 110, fluid is allowed to flow from the container 102 through the nozzle 112 and into an attached balloon. The trigger release 110 can be any manually activated valve, including but not limited to a piston slide. The fluid is released through a tube 320 that is in communication with the trigger release 110 and nozzle 112. The tube 320 runs through the container 102 and terminates near the end of the container.

As noted above, over pressurization of the container 102 can cause the container to rupture or cause damage to the pump 100. The rupturing of the container 102 raises safety concerns. A relief valve 900 may be included as part of the pump mechanism 106. The relief valve 900 may be positioned in a number of different locations, including at the end of the rod 304 of the pump handle 108, for example, in the plunger 342.

The relief valve 900 of the present invention is designed to prevent over pressuring the container 102 by releasing air back out of the sleeve 330 through the pump mechanism 106 if the pressure in the container 102 gets too great. This will effectively disengage the ability of a user to continue to pressurize the container 102 until some pressure is released by the trigger 100. As noted, the relief valve 900 can be designed to release air anywhere between 27-32 psi. The relief valve 900 cannot release air too soon or the container will not have enough pressure to fill the balloon. So, the relief valve 900 must be carefully designed to balance safety considerations over pressurization and performance of a balloon pump.

As used in this application, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

The invention claimed is:

1. A balloon filling device, the balloon filling device comprising:

a container for holding fluid, a pump mechanism for pressurizing the container, the pump mechanism having an automatic pressure relief valve for releasing air back through the pump mechanism and outside of the container when the container is over-pressurized; and a trigger mechanism for releasing fluid in the container, the trigger mechanism including a nozzle for attaching and holding a balloon while it is being filled with air or fluid and whereby the fluid can be released into the balloon for filing the balloon.

2. The device of claim 1, where the pump mechanism includes a pump handle, a rod and a plunger contained within a sleeve and where the automatic pressure relief valve is positioned within the plunger to release air back through the sleeve if the container is over-pressurized.

3. The device of claim 1, where the fluid is water, air or a mixture thereof.

4. The device of claim 1, where the automatic pressure relief valve includes a spring that will compress in response to a pressure of approximately 27-32 psi in the container.

* * * * *